US007862033B2

(12) United States Patent
Otake

(10) Patent No.: US 7,862,033 B2
(45) Date of Patent: Jan. 4, 2011

(54) PAPER FEEDING CASSETTE AND PAPER FEEDING DEVICE

(75) Inventor: Mitimasa Otake, Tokyo (JP)

(73) Assignee: Oki Data Corporation, Tokyo (JP)

( * ) Notice: Subject to any disclaimer, the term of this patent is extended or adjusted under 35 U.S.C. 154(b) by 172 days.

(21) Appl. No.: 12/354,336

(22) Filed: Jan. 15, 2009

(65) Prior Publication Data

US 2009/0189336 A1 Jul. 30, 2009

(30) Foreign Application Priority Data

Jan. 28, 2008 (JP) ..... 2008-016589

(51) Int. Cl.
*B65H 1/04* (2006.01)

(52) U.S. Cl. ..... 271/127; 271/147

(58) Field of Classification Search ..... 271/147
See application file for complete search history.

(56) References Cited

U.S. PATENT DOCUMENTS 6,086,062 A * 7/2000 Nakamura et al. ..... 271/121
6,398,205 B1 * 6/2002 Nakamura et al. ..... 271/18
6,824,133 B2 * 11/2004 Richtsmeier ..... 271/126
7,066,461 B2 * 6/2006 Asada ..... 271/121

FOREIGN PATENT DOCUMENTS

JP 2003-095446 A 4/2003

* cited by examiner

*Primary Examiner*—Stefanos Karmis
*Assistant Examiner*—Gerald W McClain
(74) *Attorney, Agent, or Firm*—Marvin A. Motsenbocker; Mots Law, PLLC

(57) ABSTRACT

An aspect of the invention provides a paper feeding cassette that comprises a cassette body; a front face wall disposed at a front end of the cassette body so as to be elevated from a bottom wall of the cassette body; a medium-stacking member disposed so as to be swingable about a support shaft relative to the cassette body by using the support shaft as a swinging center, the medium-stacking member configured to have a medium thereon stacked inside the cassette body; and a biasing unit configured to bias the medium-stacking member so as to bring the medium into contact with a feeder, wherein the front face wall comprises a face which regulates the medium along a trajectory drawn by a front end of the medium-stacking member in accordance with a swinging movement of the medium-stacking member.

5 Claims, 5 Drawing Sheets

PAPER FEEDING CASSETTE AND PAPER FEEDING DEVICE

CROSS REFERENCE TO RELATED APPLICATIONS

This application claims priority based on 35 USC 119 from prior Japanese Patent Application No. P2008-016589 filed on Jan. 28, 2008, entitled "Paper Feeding Cassette and Paper Feeding Device", the entire contents of which are incorporated herein by reference.

BACKGROUND OF THE INVENTION

1. Field of the Invention

The present invention relates to a paper feeding cassette and a paper feeding device.

2. Description of Related Art

Paper feeding cassettes are provided to conventional image forming apparatuses, such as printers, copiers, facsimiles, and multi-functional machines. Such a paper feeding cassette is detachably disposed on, for example, a printer body in a printer, that is, on an apparatus body. Paper sheets are placed on the paper feeding cassette and then the paper feeding cassette is attached on the apparatus body. This allows the paper sheets to be fed one by one to a conveyance path by using a hopping roller.

For this reason, in the paper feeding cassette, the leading end, both edges on the right and left sides, and trailing end of each paper sheet are respectively positioned by a front face wall, movably-disposed side guides, and a tail guide movably-disposed on the paper feeding cassette. In addition, the leading end of the paper sheet is pressed against the hopping roller by a paper-stacking plate disposed so as to be swingable and at a predetermined position inside the paper feeding cassette (see, for example, Japanese Patent Application Publication No. 2003-95446).

However, in the above-described paper feeding cassette, in a case where a paper sheet is raised toward the hopping roller, or where a paper sheet is brought into pressure contact with the hopping roller, the leading end of the paper sheet may be stuck with the front face wall to cause a resistance load or the leading end of the paper sheet and the front face wall may rub against each other to cause a frictional load. In such a case, force to press the paper sheet against the hopping roller, that is, pressing force, cannot be sufficiently secured. As a result, force to feed the paper sheet to the conveyance path becomes smaller, and a normal paper feeding operation cannot be performed stably.

SUMMARY OF THE INVENTION

An aspect of the invention provides a paper feeding cassette that comprises a cassette body; a front face wall disposed at a front end of the cassette body so as to be elevated from a bottom wall of the cassette body; a medium-stacking member disposed so as to be swingable about a support shaft relative to the cassette body by using the support shaft as a swinging center, the medium-stacking member configured to have a medium thereon stacked inside the cassette body; and a biasing unit configured to bias the medium-stacking member so as to bring the medium into contact with a feeder, wherein the front face wall comprises a face which regulates the medium along a trajectory drawn by a front end of the medium-stacking member in accordance with a swinging movement of the medium-stacking member.

The front face wall includes the face which regulates the medium along the trajectory drawn by the front end of the medium-stacking member in accordance with the swinging movement of the medium-stacking member. Thereby, when the medium is raised toward the feeder, or when the medium is brought into pressure contact with the feeder, the leading end of the medium is not pressed by the front face wall. Accordingly, the leading end of the medium is not stuck with the front face wall, so that a resistance load is not generated. Moreover, the leading end of the medium and the front face wall do not rub against each other, so that a frictional load is not generated.

As a result, pressing force to press the medium against the feeder can be sufficiently secured, and force to feed the medium to a conveyance path can be increased. Thus, a normal paper feeding operation can be stably performed.

DETAILED DESCRIPTION OF EMBODIMENTS

Figure 1:
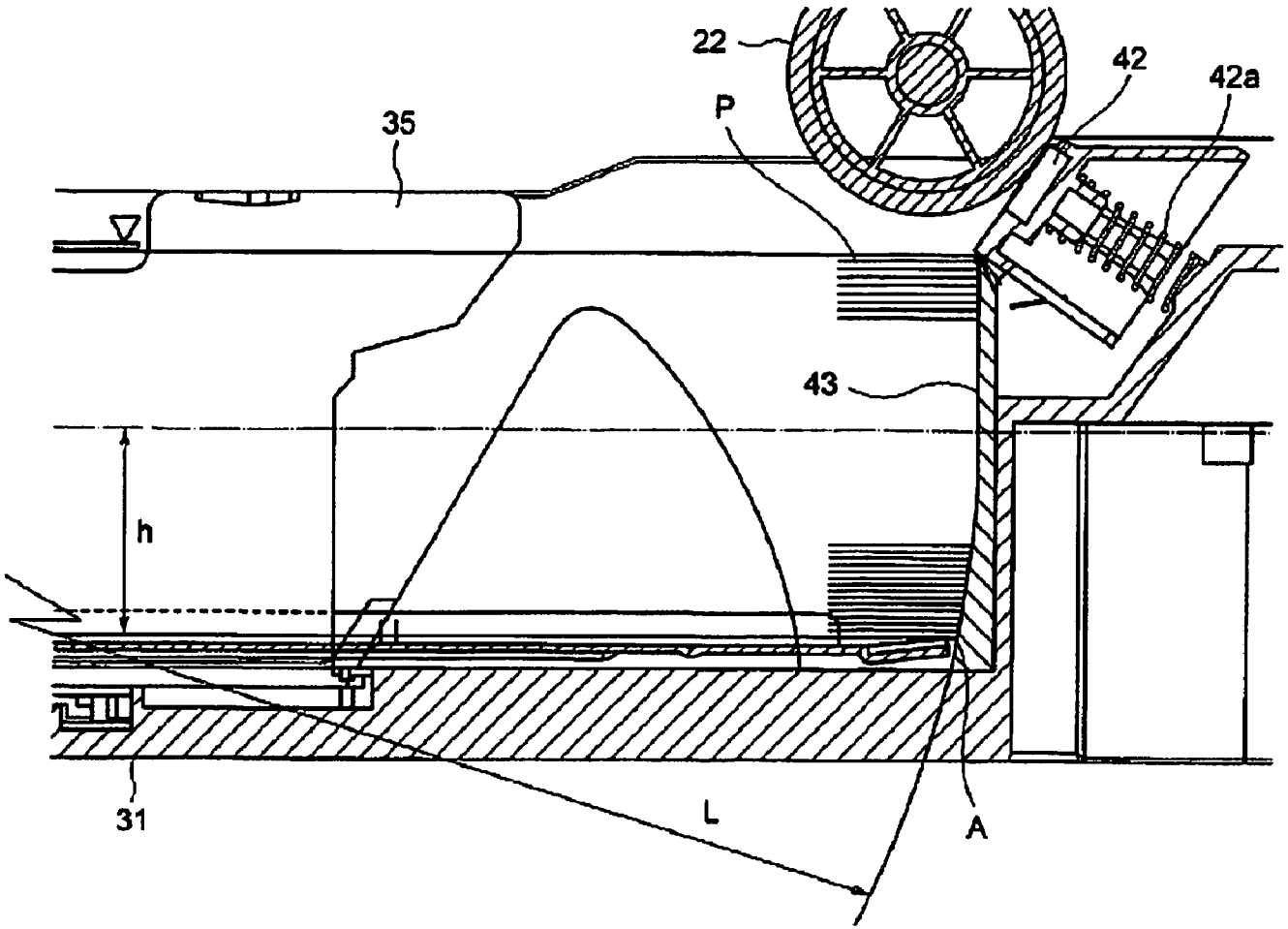
FIG. 1 is a cross-sectional view showing a principal part of a paper feeding device according to a first embodiment of the invention.

Detailed embodiments of the present invention will be described below by referring to the drawings. In the present embodiment, a printer will be described as one example of an image forming apparatus.

Prepositions, such as "on", "over" and "above" may be defined with respect to a surface, for example a surface, regardless of that surface's orientation in space. The preposition "above" may be used in the specification and claims even if a member is in contact with another member. The preposition "on" may be used in the specification and claims when a member is not in contact with another member, for example, when there is an intervening member between them.

Figure 2:
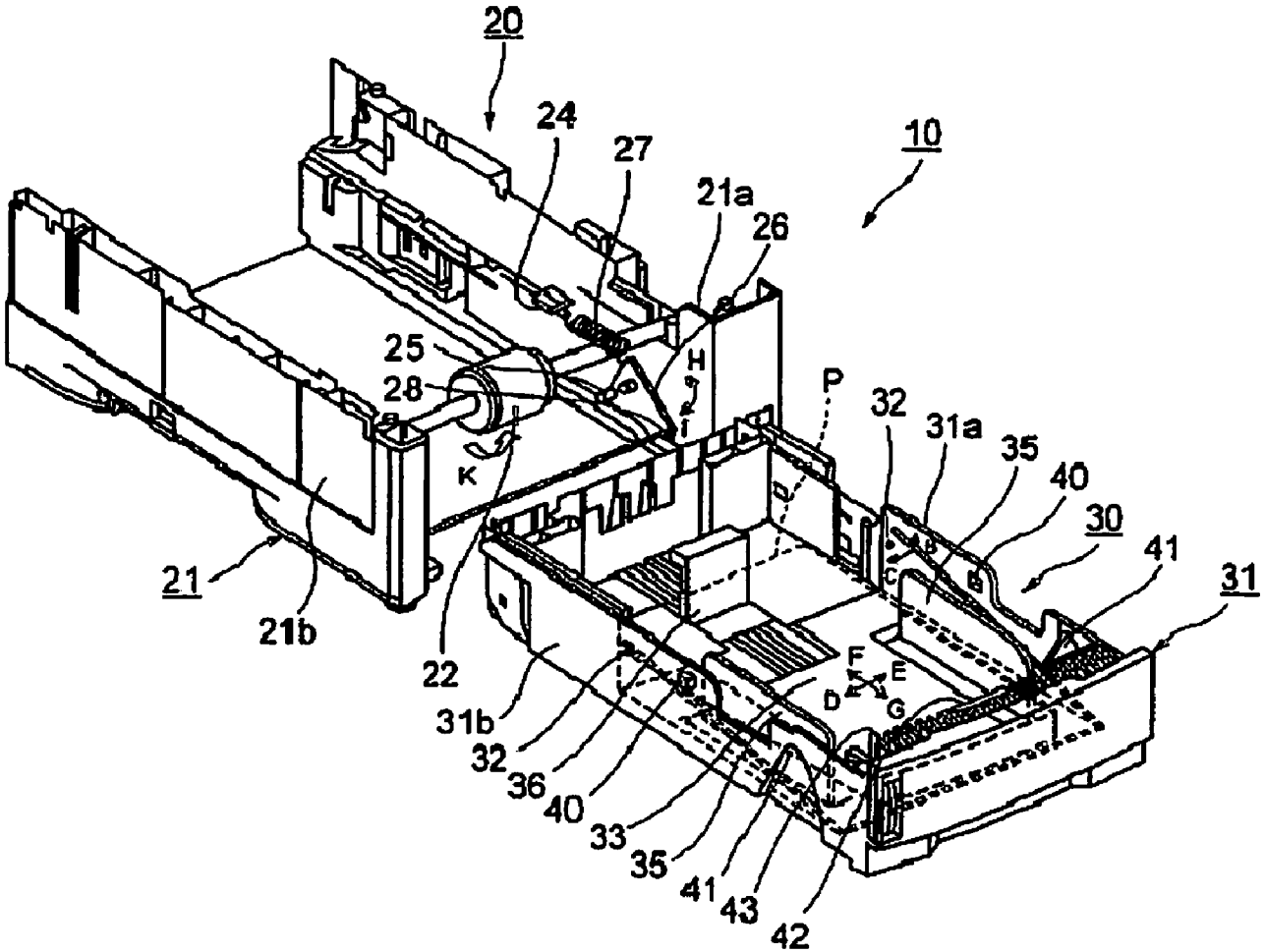
FIG. 2 is an exploded perspective view of the paper feeding device according to the first embodiment of the invention.
Figure 3:
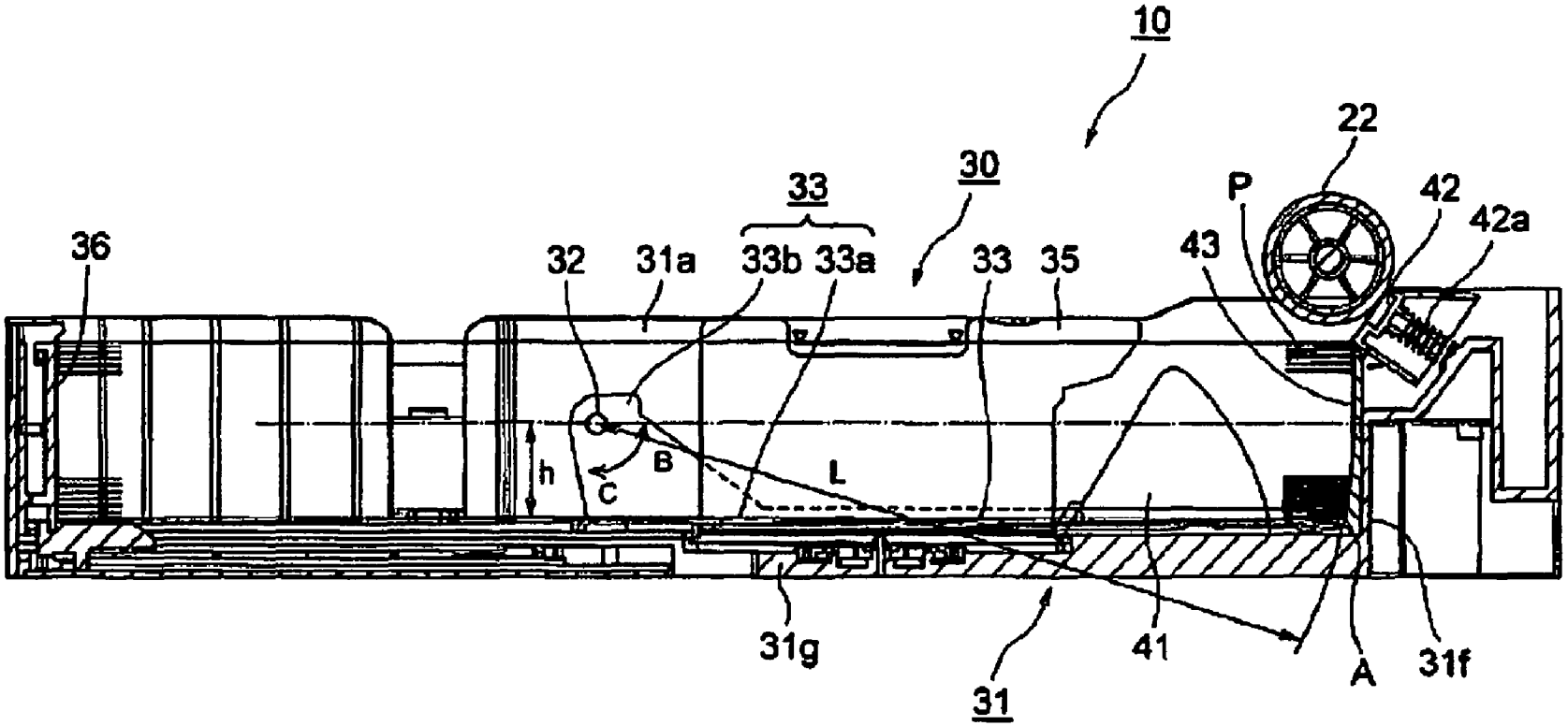
FIG. 3 is a cross-sectional view of the paper feeding device according to the first embodiment of the invention.

FIG. 2 is an exploded perspective view of a paper feeding device according to a first embodiment of the invention. FIG. 3 is a cross-sectional view of the paper feeding device according to the first embodiment of the present invention. As shown in the figures, paper feeding device 10 includes: a body of paper feeding device 10, that is, body 20; and paper feeding cassette 30 detachably disposed on body 20. Paper feeding cassette 30 includes: a body of paper feeding cassette 30, that is, cassette body 31; and paper-stacking plate 33 as a medium-stacking member.

Cassette body 31 includes front wall 31*f*, side walls 31*a* and 31*b*, and bottom wall 31*g* as well as front face wall 43 which is attached to front wall 31*f* and disposed so as to be elevated from bottom wall 31*g*.

In addition, paper sheets P as media are stacked on paper-stacking plate 33 inside cassette body 31. Paper-stacking plate 33 is disposed so as to be swingable about support shaft 32 in directions shown by arrows B and C relative to cassette body 31 by using support shaft 32 disposed on side walls 31*a* and 31*b* as the swinging center. For the swinging motion, paper-stacking plate 33 includes bottom portion 33*a* and elevated portion 33*b* which is formed by being elevated from both edges of the back end portion of bottom portion 33*a*.

Paper sheet P stacked on paper-stacking plate 33 has: a leading end (an end portion in the feeding direction of paper sheet P stacked on paper-stacking plate 33) being positioned by front face wall 43; both edges on the right and left sides being positioned by a pair of side guides 35 disposed so as to be movable in directions shown by arrows D and E; and a trailing end (an end portion in the direction opposite to the feeding direction of paper sheet P stacked on paper-stacking plate 33) being positioned by tail guide 36 disposed so as to be movable in directions shown by arrows F and G. Each of side guides 35 comes in contact with the respective edges of paper sheet P to regulate paper sheet P by justifying paper sheet P to the center portion of cassette body 31. Note that, if a paper size of paper sheet P to be set on paper feeding cassette 30 is changed, side guides 35 and tail guide 36 can be slidingly moved.

Front face wall 43 includes a face which forms a curve along a trajectory drawn by the front end of paper-stacking plate 33 at the time when paper-stacking plate 33 swings by using support shaft 32 as the swinging center. The face regulates paper sheet P at a leading end thereof. In addition, a radius of curvature of the face and a radius of curvature of the trajectory are set to be substantially equal to each other, and each of the radii of curvatures is set to be substantially equal to maximum radius L of paper sheet P stacked on paper-stacking plate 33. Note that, as shown in FIG. 3, maximum radius L refers to a distance between support shaft 32 and position A where the leading end of lowermost paper sheet P of paper sheets P stacked on paper-stacking plate 33 comes in contact with front face wall 43.

In body 20, hopping roller 22 as a feeder to feed paper sheet P is rotatably supported in a direction shown by arrow K at predetermined positions of side walls 21*a* and 21*b* of body case 21. In addition, in each of the inner sides of side walls 21*a* and 21*b*, provided are: sliding member 24 as a moving member disposed so as to be slidable (movable); link 26 as a swinging member disposed so as to be swingable about support shaft 25 in directions shown by arrows H and I by using support shaft 25 as the swinging center; and coiled spring 27 as an biasing member configured to connect sliding member 24 and link 26. Pin 28 as a locking member is attached at the tip end on the inner side of link 26 so as to inwardly protrude. Then, coil spring 27 is configured to bias paper-stacking plate 33 so as to bring paper sheet P in contact with hopping roller 22.

Meanwhile, protrusion 40 is formed on the outer side of each of side walls 31*a* and 31*b* so as to outwardly protrude, and an inversed "V"-shaped notch 41 is formed frontward of each protrusion 40 (on front face wall 43 side). In addition, friction separation pad 42 as a separation member is disposed above front face wall 43 so as to extend obliquely upward. Friction separation pad 42 is brought into pressure contact with hopping roller 22 by the biasing force from spring 42*a* as a biasing member. Note that, h is a height from the lowest point of front face wall 43 to support shaft 32 of paper-stacking plate 33.

Next, an operation of paper feeding device 10 with the above-described configuration will be described. FIG. 1 is a cross-sectional view showing a principal part of the paper feeding device according to the first embodiment of the invention. Since paper sheet P required for printing has to be set on paper feeding cassette 30 (FIG. 2), first of all, side guides 35 are disposed at a position where a distance between side guides 35 is greater than the width of paper sheet P, that is, a paper width, whereas tail guide 36 is disposed at a position where a distance between front face end 43 and tail guide 36 would be greater than the length of paper sheet P, that is, a paper length. Subsequently, the leading end and both edges of paper sheets P are kept aligned by being brought into contact with the flat faces. Then, aligned paper sheets P are stacked on paper-stacking plate 33. After that, side guides 35 are slid to come in contact with both edges of paper sheets P, thereby regulating the paper width. Then, as for the setting of paper sheets P in the longitudinal direction, the leading ends of paper sheets P are lightly brought into contact with front face wall 43 of paper feeding cassette 30 so as to be kept aligned. After that, tail guide 36 is slid so as to come in contact with the trailing ends of paper sheets P, thereby regulating the paper length. In this manner, paper sheets P are positioned inside paper feeding cassette 30 in the longitudinal and transverse directions, and thereafter set in paper feeding cassette 30.

Next, when paper feeding cassette 30 is entered into body 20, projections 40 of paper feeding cassette 30 come in contact with sliding members 24 of body 20, respectively. In addition, pin 28 disposed in support shaft 25 is brought into contact with a side edge of paper-stacking plate 33.

Subsequently, when paper feeding cassette 30 is further entered into body 20, sliding members 24 are moved backward to rotate link 26 in a direction shown by arrow H with coil spring 27 being extended. After that, along with the rotation of link 26, pin 28 is moved in the direction shown by arrow H along the circumferential surface of notch 41, and paper-stacking plate 33 is rotated in a direction shown by arrow B (FIG. 3) by using support shaft 32 as the rotation center. At this time, the leading end of paper sheet P is brought upward along front face wall 43 in accordance with the rotation of paper-stacking plate 33. Then, uppermost paper sheet P of paper sheets P stacked on paper-stacking plate 33 is brought into pressure contact with hopping roller 22 with a predetermined tension.

When paper feeding cassette 30 is set in body 20, friction separation pad 42 is brought into pressure contact with hopping roller 22 by the biasing force from spring 42*a*.

Then, an unillustrated paper feeding motor as a driving unit is driven. The rotation of the paper feeding motor is transmitted to hopping roller 22, and hopping roller 22 is rotated in the direction shown by arrow K. Then, paper sheet P is moved toward friction separation pad 42 by frictional force between hopping roller 22 and paper sheet P. As a result, single uppermost paper sheet P separated from residual paper sheets P by friction separation pad 42 is fed out.

In a case where paper sheet P is raised toward hopping roller 22, or where paper sheet P is brought into pressure contact with hopping roller 22, the leading end of paper sheet P may be stuck with front face wall 43 to cause a resistance load or the leading end of paper sheet P and front face wall 43 may rub against each other to cause a frictional load. In such a case, the pressing force to press paper sheet P against hopping roller 22 cannot be secured sufficiently. As a result, force to feed paper sheet P becomes smaller, and the normal paper feeding operation cannot be performed stably.

For this reason, as described above, front face wall 43 includes a face which forms a curve along the trajectory drawn by the front end of paper-stacking plate 33 at the time when paper-stacking plate 33 swings by using support shaft 32 as the swinging center. The radius of curvature of the face and the radius of curvature of the trajectory are set to be substantially equal to each other, and each of the radii of curvatures is set to be substantially equal to maximum radius L of paper sheet P stacked on paper-stacking plate 33.

Note that, in terms of manufacturing, it is conceivably appropriate that: the radius of curvature of the face and maximum radius L are set to be substantially equal to each other in the portion with height h; and an inclination equivalent to a molding draft is formed in a portion higher than height h (inclined about 2° to 3° toward the front).

That is, in the portion substantially equal to or lower than height h, the radius of curvature of the face of front face wall 43 on paper sheet P side and maximum radius L are set to be substantially equal. This is because an ascending load of paper sheets P is increased if the radius is substantially equal to or smaller than the maximum radius. In the portion substantially equal to or higher than height h, the radius of curvature of the face of front face wall 43 on paper sheet P side may be set to be substantially equal to maximum radius L. In terms of draft formation during manufacturing, it is preferable that the radius of curvature of the face be set to be substantially equal to or larger than maximum radius L. Here, the draft refers to an inclination which is formed on an outer part surface of a molded product so as to facilitate separation of the molded product from a mold cavity. An angle of the draft is determined on the basis of a material and shape of the molded product or whether or not the surface thereof is grain-finished, i.e., the surface is roughened. Note that, since injection molding may cause mold shrinkage after a molten plastic is formed, it is preferable that an inclination on the cavity side be formed as small as possible and an inclination on the core side be formed large.

In this manner, in the present embodiment, the radius of curvature of the face of front face wall 43 and maximum radius L are set to be equal. Accordingly, when paper sheet P is raised toward hopping roller 22 or when paper sheet P is brought into pressure contact with hopping roller 22, the leading end of paper sheet P is not pressed by front face wall 43. Thus, a resistance load is not caused because the leading end of paper sheet P is not stuck with front face wall 43. Moreover, a frictional load is not caused because the leading end of paper sheet P and front face wall 43 do not rub against each other.

As a result, the pressing force to press paper sheet P against hopping roller 22 can be sufficiently secured, and the force to feed paper sheet P to the conveyance path can be increased. Thus, a normal paper feeding operation can be stably performed.

When paper sheets P are set in paper feeding cassette 30, the leading ends of paper sheets P are lightly brought into contact with front face wall 43 to be aligned and then tail guide 36 is slid so as to come in contact with the trailing ends of paper sheets P to thereby regulate the paper length. At that time, it is no more necessary to form, in advance, spaces between the leading ends of paper sheets P and front face wall 43 and between the trailing ends of paper sheets P and tail guide 36. Thus, the operation of setting paper sheets P in paper feeding cassette 30 can be simplified.

Next, description will be given of a comparative example in which the radius of curvature of the face of front face wall 43 is set to be larger than maximum radius L.

Figure 4:
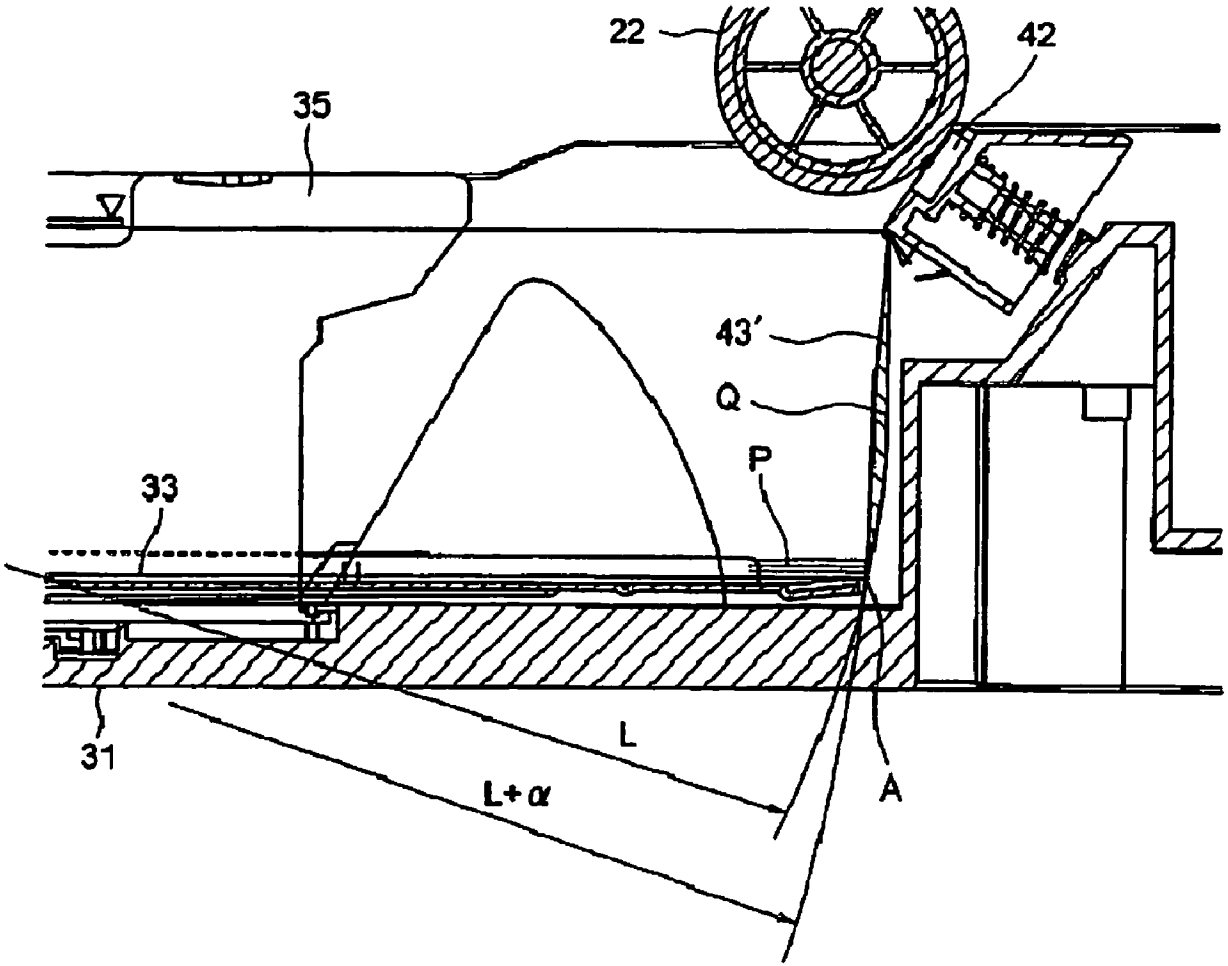
FIG. 4 is a cross-sectional view showing a principal part of a paper feeding device in a comparative example of the first embodiment of the invention.

FIG. 4 is a cross-sectional view showing a principal part of a paper feeding device in a comparative example of the first embodiment of the invention. As shown in the figure, when a radius of curvature of a face of front face wall 43' is set to be L+α, which is larger than maximum radius L, front face wall 43' is positioned on the inner side to trajectory Q drawn by the front end of paper-stacking plate 33 by the amounts shown by hatching. Accordingly, when paper sheet P is raised toward hopping roller 22, or when paper sheet P is brought into pressure contact with hopping roller 22, the leading end of paper sheet P is pressed by front face wall 43'. Thus, the leading end of paper sheet P is stuck with front face wall 43', causing a resistance load, or the leading end of paper sheet P and front face wall 43' rub against each other, causing a frictional load. Note that, reference numeral 31 denotes a cassette body, reference numeral 35 denotes a side guide, reference numeral 42 denotes a friction separation pad, and reference symbol A denotes a position.

Next, a second embodiment of the present invention will be described. Note that, components with the structure same as those of the first embodiment will be denoted by the same reference numerals. As for effects of the embodiment brought by having the same structure as the first embodiment, the effects of the first embodiment are claimed.

Figure 5:
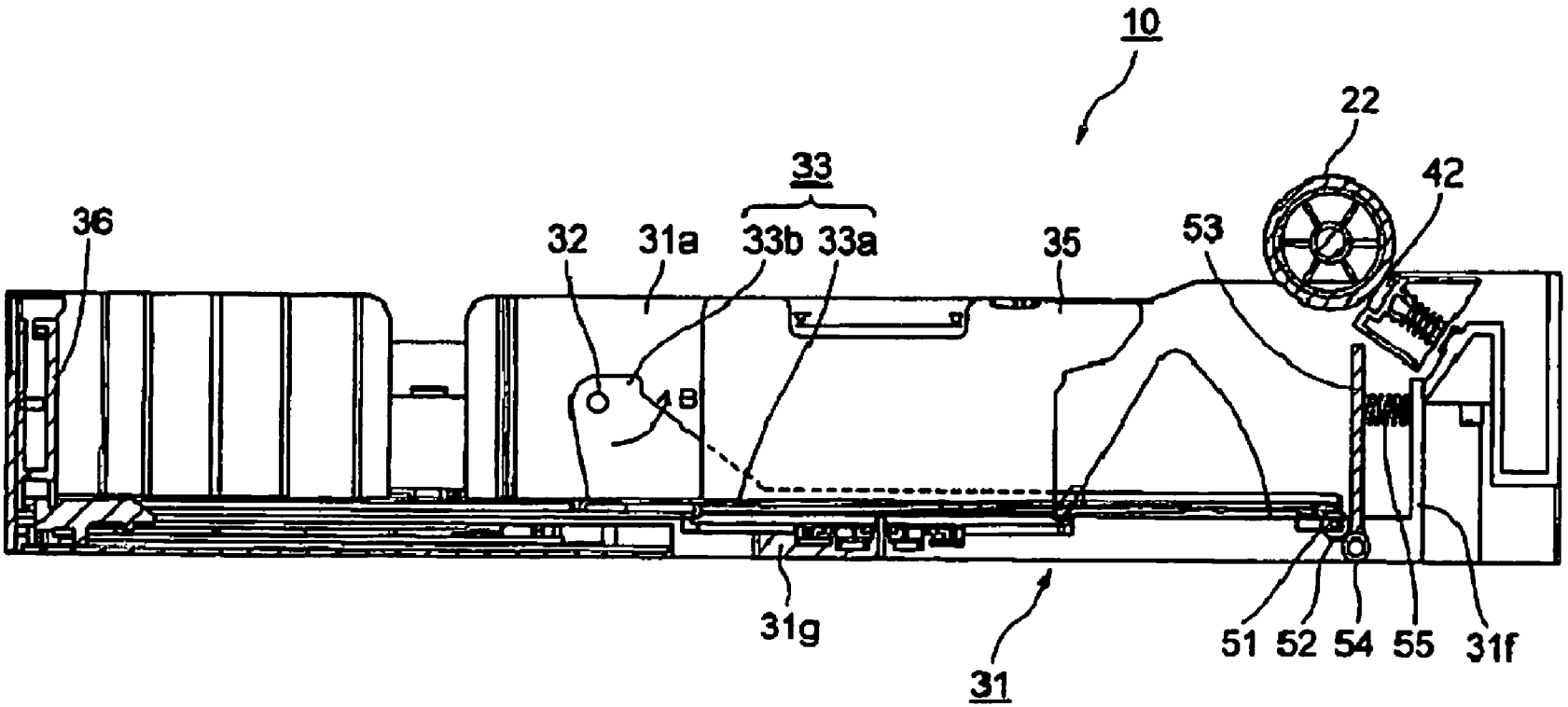
FIG. 5 is a cross-sectional view of a paper feeding device according to a second embodiment of the invention.

FIG. 5 is a cross-sectional view of a paper feeding device according to the second embodiment of the invention. In this case, front face wall 53 is disposed in a vicinity of front wall 31*f* of cassette body 31 so as to be parallel with front wall 31*f*. Front face wall 53 has a planar shape, and a lower end thereof is supported by support shaft 54 disposed in bottom wall 31*g* of cassette body 31 so as to be swingable relative to cassette body 31. Front face wall 53 is configured to regulate the leading end of paper sheet P (FIG. 2) as a medium. One pair of springs 55 as biasing members are disposed at predetermined portions on the right and left sides between front wall 31*f* and front face wall 53. Each spring 55 is configured to bias front face wall 53 in the direction opposite to the feeding direction of paper sheet P by a predetermined biasing force.

In addition, support shaft 51 is disposed adjacent to support shaft 54 on each of both right and left edges of the front end of paper-stacking plate 33 as a medium-stacking member. Roller 52 as a rotor is configured to rotatably fit to support shaft 51 while being in contact with front face wall 53.

Next, an operation of paper feeding device 10 with the above-described configuration will be described. In the embodiment, when paper-stacking plate 33 rotates in the direction shown by arrow B, roller 52 disposed at the front end of paper-stacking plate 33 moves upward along a face of front face wall 53. At this time, front face wall 53 is biased by springs 55. Accordingly, roller 52 is rotated while being in pressure contact with front face wall 53.

Accordingly, front face wall 53 is rotated by using support shaft 54 as the rotational center so that a portion thereof which is in contact with roller 52 can move along a trajectory of the front end of paper-stacking plate 33.

In this case, when paper sheet P stacked on paper-stacking plate 33 is raised toward hopping roller 22 as a feeder, or when paper sheet P is brought into pressure contact with hopping roller 22, front face wall 53 swings along with the trajectory drawn by the front end of paper-stacking plate 33. Thus, the leading end of paper sheet P is not pressed by front face wall 53. Accordingly, the leading end of paper sheet P is not stuck with front face wall 53, so that a resistance load is not generated. Moreover, the leading end of paper sheet P and front face wall 53 do not rub against each other, so that a frictional load is not generated.

As a result, the pressing force to press paper sheet P against hopping roller 22 can be sufficiently secured, and the force to feed paper sheet P to the conveyance path can be increased. Thus, a normal paper feeding operation can be stably performed.

As described above, the paper feeding cassette and paper feeding device according to the present embodiment can stably perform normal paper feeding operation.

Note that, in the above-described embodiments, a printer has been described as an image forming apparatus. However, those embodiments can be employed to all image forming apparatuses having a function to feed a medium, including a paper sheet, to a conveyance path when an image is formed on the medium. For example, the above-described embodiments can be employed to a copier, a facsimile device, a multi-functional machine, and the like, in which supplied toner is transferred.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A paper feeding cassette, comprising:

a cassette body;

a front face wall disposed at a front end of the cassette body so as to be elevated from a bottom wall of the cassette body;

a medium-stacking member disposed so as to be swingable about a support shaft relative to the cassette body by using the support shaft as a swinging center, the medium-stacking member configured to have a medium thereon stacked inside the cassette body; and a biasing unit configured to bias the medium-stacking member so as to bring the medium into contact with a feeder, wherein the front face wall comprises a face which regulates the medium along a trajectory drawn by a front end of the medium-stacking member in accordance with a swinging movement of the medium-stacking member;

wherein the front face wall comprises a face having a radius of curvature substantially equal to a radius of curvature of the trajectory drawn by the front end of the medium-stacking member in accordance with the swinging movement of the medium-stacking member.

2. The paper feeding cassette of claim 1, wherein the radius of curvature of the trajectory drawn by the front end of the medium-stacking member is a distance between the support shaft and a position where a leading end of a lowermost medium stacked on the medium-stacking member comes in contact with the front face wall.

3. The paper feeding cassette of claim 1, wherein a distance from the support shaft to a lowest point of the front face wall is substantially equal to a distance from the support shaft to the front face wall that is in parallel to the medium-stacking member.

4. The paper feeding cassette of claim 1, wherein the front face wall is inclined in a portion higher than a height from the medium-stacking member to the support shaft.

5. A paper feeding device, comprising:

a body including a feeder configured to feed a medium; and a paper feeding cassette detachably provided to the body, the paper feeding cassette including:

a cassette body;

a front face wall disposed at a front end of the cassette body so as to be elevated from a bottom wall of the cassette body;

a medium-stacking member disposed so as to be swingable about a support shaft relative to the cassette body by using the support shaft as a swinging center, the medium-stacking member configured to have a medium thereon stacked inside the cassette body; and a biasing unit configured to bias the medium-stacking member so as to bring the medium into contact with the feeder, wherein the front face wall comprises a face which regulates the medium along a trajectory drawn by a front end of the medium-stacking member in accordance with a swinging movement of the medium-stacking member;

wherein the front face wall comprises a face having a radius of curvature substantially equal to a radius of curvature of the trajectory drawn by the front end of the medium-stacking member in accordance with the swinging movement of the medium-stacking member.

* * * * *